United States Patent [19]

Martinetti

[11] Patent Number: 4,827,096

[45] Date of Patent: May 2, 1989

[54] UNIVERSAL SWITCH WITH INTEGRAL CONTACT TABS

[76] Inventor: Bruno Martinetti, Via Udine 19, 33030 Dignano (UD), Italy

[21] Appl. No.: 71,229

[22] PCT Filed: Nov. 4, 1986

[86] PCT No.: PCT/IT86/00080

§ 371 Date: Jun. 9, 1987

§ 102(e) Date: Jun. 9, 1987

[87] PCT Pub. No.: WO87/02823

PCT Pub. Date: May 7, 1987

[30] Foreign Application Priority Data

Nov. 5, 1985 [IT] Italy ..... 83432 A/85

[51] Int. Cl.[4] ..... H01H 1/06

[52] U.S. Cl. ..... 200/275; 200/243; 200/284

[58] Field of Search ..... 200/284, 243, 238, 275; 337/314, 315, 354

[56] References Cited

U.S. PATENT DOCUMENTS

| | | | |
|---|---|---|---|
| 2,824,194 | 2/1958 | Moorhead | 337/354 |
| 3,612,793 | 10/1971 | Roeser | 200/284 |
| 3,882,440 | 5/1975 | Hollweck et al. | 337/354 |
| 4,350,967 | 9/1982 | Doherty, Jr. | 337/343 |

FOREIGN PATENT DOCUMENTS

| | | | |
|---|---|---|---|
| 182487 | 5/1986 | European Pat. Off. . | |
| 2460860 | 7/1976 | Fed. Rep. of Germany | 337/354 |
| 2505966 | 8/1976 | Fed. Rep. of Germany | 337/354 |
| 2748435 | 5/1979 | Fed. Rep. of Germany | 200/238 |
| 1175864 | 4/1959 | France | 337/354 X |
| 2266278 | 10/1975 | France . | |

*Primary Examiner*—Renee S. Luebke

*Attorney, Agent, or Firm*—Wenderoth, Lind & Ponack

[57] ABSTRACT

A compact universal switch with integral contact tabs which includes a housing, an axially slidable connecting bar for movement in an axial direction and a pair of spaced-apart L-shaped contact tabs fixed to the housing such that the axially slidable connecting bar is movable between the contact tabs, the contact tabs each comprising a deformable metallic electrically conductive plate having a leg portion and a foot portion having a contact thereon. An axial bar actuation device is fixed to the housing for moving the axially slidable connecting bar in the axial direction and a connection bridge is provided for completing interrupting an electric circuit between the contact tabs in response to movement of the axially slidable connection bar. A tab-contact insulating case is fixed to the housing and at least partially covers the contact tabs. A lower part of the leg portion of each of the contact tabs extends in the axial direction and opposed surfaces of the lower parts of the leg portions are parallel to each other. The foot portion of each of the contact tabs extends perpendicularly from the lower part of the leg portion and is spaced from the foot portion of the leg portion of the other one of contact tabs in a lateral direction parallel to a plane containing one of the opposed surfaces of the lower parts of the leg portions.

12 Claims, 3 Drawing Sheets

FIG. 2
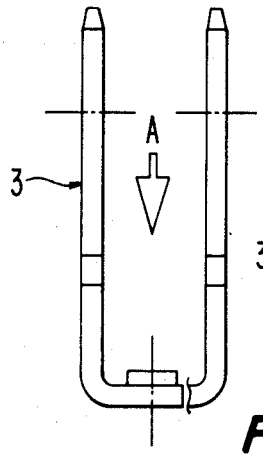
FIG. 2b
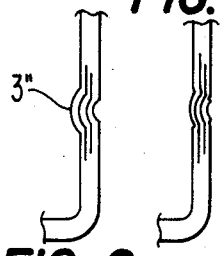
FIG. 2c
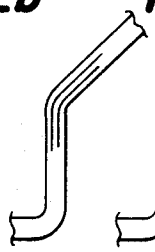
FIG. 2d
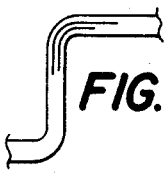
FIG. 2a
FIG. 3
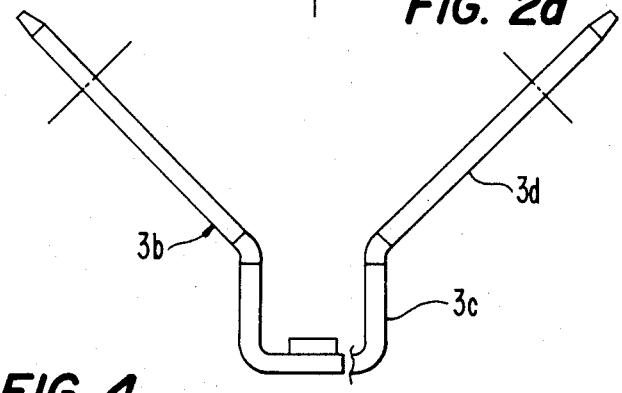
FIG. 4
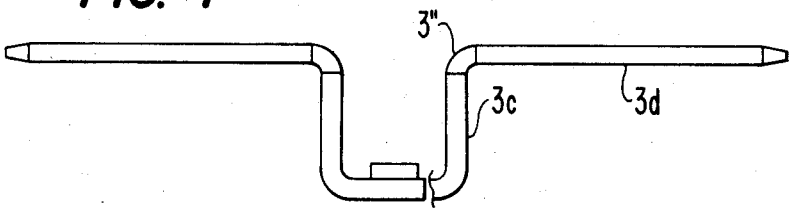
FIG. 5
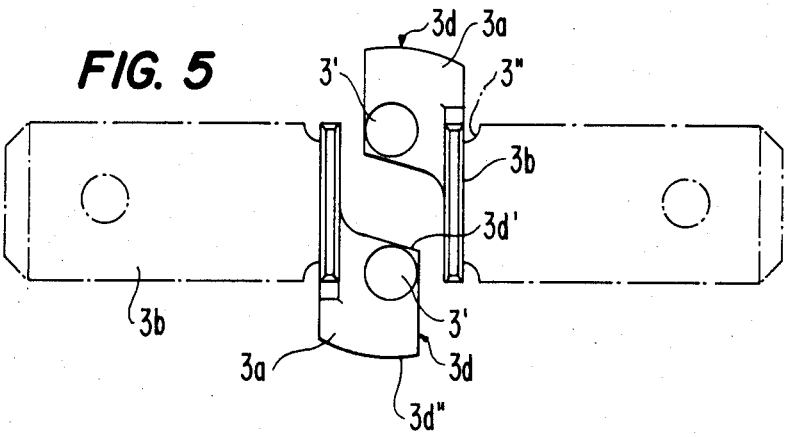

3"

UNIVERSAL SWITCH WITH INTEGRAL CONTACT TABS

BACKGROUND OF THE INVENTION

1. Field of the Invention

This invention relates to a UNIVERSAL SWITCH WITH INTEGRAL CONTACT TABS. This invention is useful in electric switches and similar devices, including thermostatic switches or similar devices which are power-operated and/or controlled by various parameters (moisture meters, thrust meters, etc.).

2. Description of the Prior Art

Conventional switches usually have different functions but each particular switch has a feature of being designed for one specific function. Therefore, they usually involve complex manufacturing problems due to the necessity of producing different types of devices according to the application they are intended for. For example, the necessity to have a different fixing system for attaching the switch to an object with which it is to be used involves the production of a specific device for this purpose.

Moreover, the conventional switches are generally designed with contact strips made of valuable materials and such strips are generally riveted or welded so that they cannot be replaced.

SUMMARY OF THE INVENTION

This invention aims at removing the above mentioned disadvantages by means of a simple, cheap and highly reliable device having a high conductance. The invention also provides a universal support fixing means and a tab-contact insulating case.

This invention solves the above-mentioned problem by means of an interchangeability of the support fixing means and of the tab-contact insulating case of the switch.

The inventive features allow:

the fixing of the switch by different systems, thus adjusting the switch itself to the specific requirements of various appliances;

the electrical connection by different systems.

In its preferred form, the switch has two composition-metal tabs which are electric conductors and originally L-shaped. The lower part of the "L" is the part intended to make electrical contact being associated with a bridge conductor which allows the opening and closing of the circuit.

This feature makes the switch universal as either different ways of fixing the switch to a support or different insulating cases can be used.

A further important characteristic of such contact tabs is that they are "weakened", i.e. the material thereof is pre-yielded in order to obtain various possibilities of bending after the assembly.

This characteristic also allows different orientations of the contact tabs.

BRIEF DESCRIPTION OF THE DRAWINGS

The invention will now be explained in detail with reference to the accompanying drawings which show some preferential embodiments whose manufacturing details, however, are purely illustrative and not restrictive.

FIG. 2 shows a front view of a pair of contact tabs which, in this case, are used in a single-circuit switch.

FIGS. 3*a–d* show the successive stages of the yielding operation carried out on a contact tab so that it can be bent in the desired position.

FIG. 3 shows one of the possible bending positions of the contact tab.

FIG. 4 shows a different orientation of the contact tab shown in FIG. 3.

FIG. 5 shows a view from side A of the contact tabs shown in FIG. 2; the dashing points out the bending solution according to FIG. 4.

DESCRIPTION OF THE PREFERRED EMBODIMENTS

Figure 1:
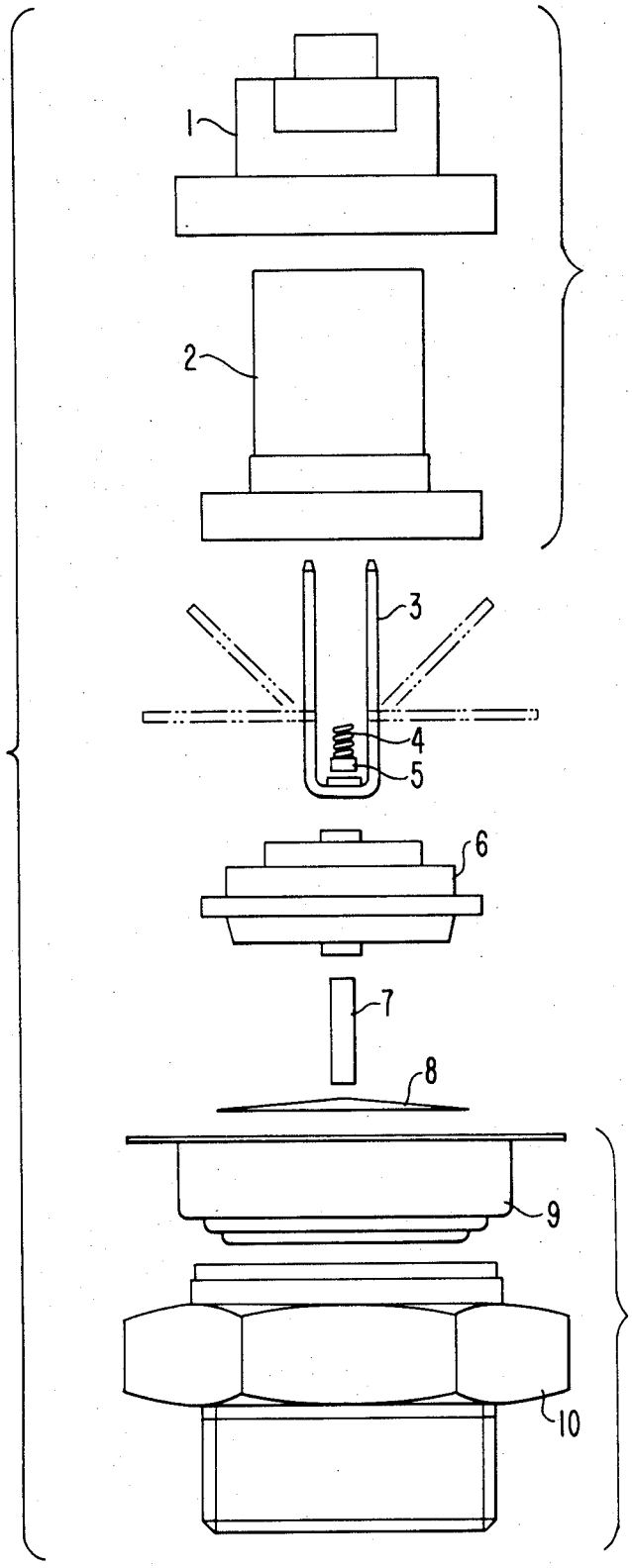
FIG. 1 shows a schematic view of possible combinations of components which, in this case, may form after assembly four different thermostatic switches.
Figures 6A, 6B, 6C, 6D:
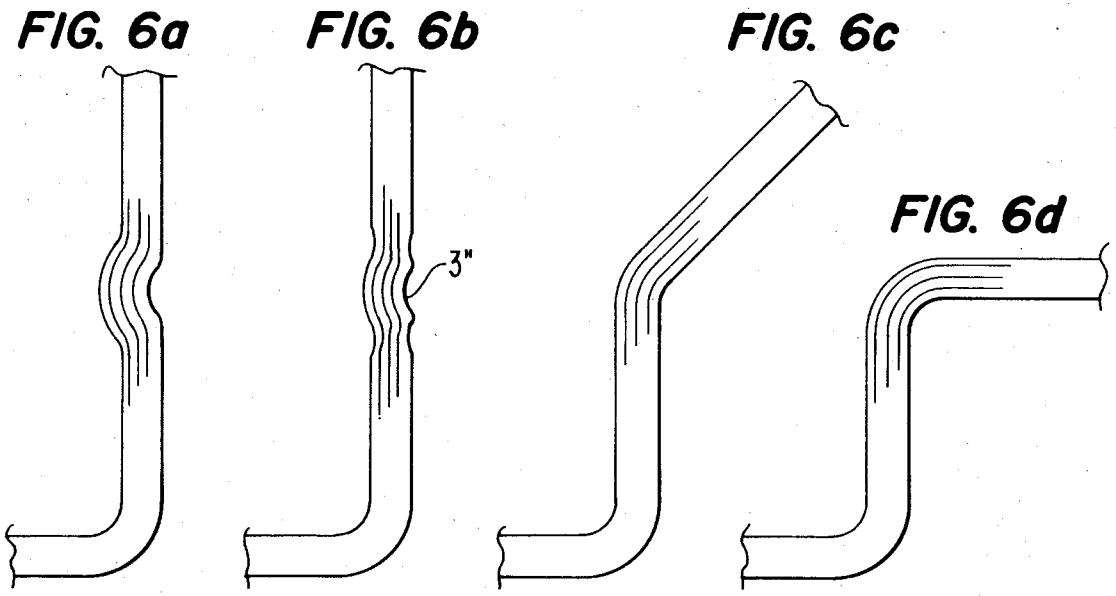
FIG. 6*a–d* show an enlarged view of the fibers during thee pre-bending operation (FIGS. 6*a* and 6*b*) and the possible final bending after assembly (FIGS. 6*c* and 6*d*).

As outlined in the above mentioned figures the preferred thermostatic switch includes a switch formed by two spaced-apart opposed contact tabs which are each formed from a deformable metallic electrically conductive plate. The contact tabs include a foot portion 3*a* and a leg portion 3*b*, the leg portion 3*b* including at least a part 3*c* thereof which extends in an axial direction such that the parts 3*c* of both contact tabs 3 are parallel to each other, as shown in FIGS. 4 and 5. The foot portion 3*a* extends perpendicularly from the part 3*c* and the foot portions 3*a* of both of the contact tabs 3 are spaced apart in a direction parallel to a plane containing a surface of the part 3*c*, as shown in FIG. 5. An outer periphery 3*d* of the foot portion 3*a* has one side 3*d*′ thereof extending from a central portion of the lower part 3*c* of the leg portion 3*b*. A contact 3′ is provided on each foot portion 3*a* such that the contact 3′ extends in the axial direction away from the foot portion 3*a* and a portion of the contact 3′ faces the part 3*c* of the leg portion with a gap therebetween as shown in FIGS. 4 and 5. The contact 3′ is located closer to the one side 3*d*′ of the foot portion 3*a* than to another side 3*d*′ of the foot portion which is opposite to the one side 3*d*′. The leg portion 3*b* has an edge at a free end thereof which extends in a lateral direction and the foot portions 3*a* are spaced apart in a direction parallel to the edge. A connection bridge means comprising a bridge conductor 5 extends in the lateral direction and is movably mounted within a housing 9 or 10 such that it completes and interrupts an electric circuit between the contacts 3′ of the two contact tabs 3. The connection bridge means further includes a spring device 4 which keeps the bridge conductor 5 elastically in touch with the contacts 3′ of the two contact tabs 3.

An axial bar actuation means comprising an impulse device is provided which cooperates with an axially slidable connecting bar 7 movable in an opening extending through a guide 6 to operate the bridge conductor 5 from an ON to an OFF position and vice versa by moving the connecting bar 7.

An interchangeable, variously shaped case 1 or 2 is fixed to the housing for partially covering or entirely covering the contact tabs 3, depending on the length of the case. The housing comprises an interchangeable, variously shaped case 9 or 10 which contains the bar actuation means 8, the connecting bar 7 and the guide 6. In particular, the case containing the switch can be either a short type 1 where the contact tabs 3 extend outwardly therefrom to provide the conventional "faston" connection or the case can be long type 2 where the contact tabs are entirely enclosed inside the case, so that the case itself can act as a protected connector. In the same way, the housing containing the axial bar actuation means 8 can be a plain cap 9, e.g. when the switch is fitted on washing machines, coffee-makers, etc. or the housing 10 can be provided with a thread, e.g. when the switch is screwed on the radiator of a vehicle.

Moreover, it is important to emphasize that a weakened area 3'' is provided on the leg portion **3*b* of each contact tab 3 by a bending operation (shown in FIGS. 2*a* and 2*b*) carried out on the contact tab 3 which consists of 2 stages, the first of which is a "cove" bending obtained by cold molding (as shown in FIG. 2*a*) and the second of which is a cold squeezing of the bend (as shown in FIG. 2*b*) in order to bring the contact tab 3 back into line. This will allow, after assembly, the bending of a free end portion 3*d*** of the contact tab which provides the "faston" connection in the desired position.

In a thermostatic switch, the above mentioned axial bar actuation means 8 consists of a bimetallic disc which warps from concave to convex and vice versa according to the temperature, thus pushing the connecting bar 7, which is of an insulating material, in the axial direction guided by the guide 6.

While the present invention has been described with reference to the foregoing embodiments, it will be understood that various changes and modification may be made thereto which fall within the scope of the appended claims.

I claim:

1. A universal switch comprising:

a housing;

an axially slidable connecting bar supported by said housing for movement in an axial direction;

a pair of spaced-apart L-shaped contact tabs fixed to said housing such that said axially slidable connecting bar is movable between said contact tabs, said contact tabs each comprising a deformable metallic electrically conductive plate having a leg portion and a foot portion, at least part of said leg portion of each of said contact tabs extending in said axial direction such that opposed surfaces of said parts of said leg portions are parallel to each other, said foot portion of each of said contact tabs extending perpendicularly from said part of said leg portion and being spaced from said foot portion of said leg portion of the other one of said contact tabs in a lateral direction parallel to a plane containing one of said opposed surfaces, said foot portion having a contact thereon, the outer periphery of said foot portion having one side thereof extending from a central portion of said part of said leg portion;

an axial bar actuation means fixed to said housing for moving said axially slidable connecting bar in said axial direction;

a connection bridge means movably mounted within said housing for completing and interrupting an electric circuit between said contact of one of said contact tabs and said contact of the other one of said contact tabs in response to movement of said axially slidable connection bar when said axially slidable connecting bar is caused to move by said axial bar actuation means; and a tab-contact insulating case fixed to said housing and at least partially covering said contact tabs.

2. The universal switch of claim 1, wherein said case completely covers said foot portion and said leg portion of each of said contact tabs.

3. The universal switch of claim 1, wherein said housing includes threads on the outer periphery thereof for attaching said housing to an object by screwing said housing in a threaded hole in said object.

4. The universal switch of claim 1, wherein said foot portion of one of said contact tabs is coplanar with said foot portion of the other one of said contact tabs, said contact tabs being identically shaped with opposite edges of said leg portion of one of said contact tabs being aligned with opposite edges of said leg portion of the other one of said contact tabs.

5. The universal switch of claim 1, wherein said contact of one of said contact tabs is aligned with said contact of the other one of said contact tabs in said lateral direction.

6. The universal switch of claim 1, wherein said leg portion of each of said contact tabs further includes a free end portion which is not parallel to said part of said leg portion.

7. The universal switch of claim 6, wherein said leg portion of each of said contact tabs includes at least one weakened area for allowing said free end portion to be bent at an angle with respect to said part of said leg portion.

8. The universal switch of claim 1, wherein said contact is located closer to said one side of said foot portion than to another side of said foot portion which is opposite to said one side.

9. The universal switch of claim 1, further comprising a guide fixed to said housing, said guide having an opening therethrough through which said connecting bar extends for guiding said connecting bar during movement thereof in said axial direction, said connecting bar being of an insulating material.

10. The universal switch of claim 1, wherein said axial bar actuation means comprises a bimetallic disc having a convex shape at one temperature and a concave shape at another temperature, said disc being engageable with said connecting bar for movement thereof in said axial direction.

11. The universal switch of claim 1, wherein said connection bridge means comprises a bridge conductor extending in said lateral direction and spring means for biasing said bridge conductor towards said contact on each of said contact tabs.

12. The universal switch of claim 1, wherein said axial bar actuation means includes means for moving said connecting bar in response to changes in temperature of a medium exposed to said axial bar actuation means.

* * * * *